United States Patent [19]

Simm

[11] 3,978,492

[45] Aug. 31, 1976

[54] PROCESS FOR THE ELECTROGRAPHIC RECORDING OF CHARGE IMAGES IN A LOW ELECTRON AFFINITY CASE

[75] Inventor: Walter Simm, Leverkusen, Germany

[73] Assignee: AGFA-Gevaerts, A.G., Leverkusen, Germany

[22] Filed: Feb. 13, 1975

[21] Appl. No.: 549,669

Related U.S. Application Data

[63] Continuation of Ser. No. 291,045, Sept. 21, 1972, abandoned.

[30] Foreign Application Priority Data

Sept. 25, 1971 Germany ..... 2148001

[52] U.S. Cl. ..... 346/74 J; 346/74 ES

[51] Int. Cl.[2] ..... G03G 15/044; G03G 13/044

[58] Field of Search ..... 346/74 J, 74 EB, 74 ES, 346/74 S, 74 SB, 74 SC, 74 EE; 317/262 A

[56] References Cited

UNITED STATES PATENTS

| | | | |
|---|---|---|---|
| 3,141,170 | 7/1964 | Wilkerson | 346/74.1 |
| 3,161,544 | 12/1964 | Berry | 346/74.1 |
| 3,370,546 | 2/1968 | Müller | 346/74.1 |
| 3,495,269 | 2/1970 | Mutschler | 346/74 J |
| 3,623,123 | 11/1971 | Jvirblis | 346/74 J |
| 3,735,416 | 5/1973 | Ott | 346/74.1 |
| 3,742,516 | 6/1973 | Cavenaugh et al. | 346/74 J |
| 3,750,190 | 7/1973 | Ohkubo et al. | 346/74 J |

*Primary Examiner*—Bernard Konick
*Assistant Examiner*—Jay P. Lucas
*Attorney, Agent, or Firm*—Connolly and Hutz

[57] ABSTRACT

Process for the electrophotographic recording of charge images on insulating recording material, wherein a gas discharge and the imagewise control of the discharge current which is used for charging the recording material take place in the presence of one or more gases which have an electron affinity of less than 1 eV.

14 Claims, 7 Drawing Figures

PROCESS FOR THE ELECTROGRAPHIC RECORDING OF CHARGE IMAGES IN A LOW ELECTRON AFFINITY CASE

This application is a continuation of copending U.S. application Ser. No. 291,045, filed Sept. 21, 1972, now abandoned, entitled Process for the Electrographic Recording of Charge Images.

This invention relates to a process for the electrographic recording of charge images on a recording material which is capable of being electrically charged.

Electrographic recording processes are known in which the images are recorded e.g. by means of a cathode ray tube, the charge of the electron beam being transmitted to the recording material by means of pin electrodes which are uniformly distributed in rows in the front plate of the tube. For this purpose, the recording paper is moved past the electrodes at a distance of only a few $\mu$m to enable the charge to be transferred. The position and intensity of the electron beam in the tube can be controlled by a video signal so that a charge image is formed on the paper.

In another known process, electrodes which are shaped in the form of images, e.g. printing forms in the shape of letters or numerals, are used for electrostatic printing. In this case, the recording paper is introduced between the printing form and a flat counterelectrode and charged by a brief voltage impulse so that the image of the printing form is transferred to the paper. The transfer of the charge is effected by brief ignition of a gas discharge in the space between the electrode and the surface of the paper, using voltages of e.g. 500 to 1500 V and keeping the paper at a very small distance from the electrode.

All these processes, which require the distance between the electrode and the paper to be kept very small for the recording and in which moreover each new signal requires the ignition and extinction of a fresh gas discharge between the individual electrode pairs, have the disadvantage that the ignition voltage depends largely on the surface irregularities of the recording material, the temperature and moisture content of the air and impurities in the air in the form of dust particles.

These difficulties can be overcome to a large extent by other known processes in which larger electrode distances can be employed and the ignition of a large number of individual gas discharges is unnecessary for the transfer of the charge. In these processes, the charge current is produced by means of corona discharge which is operated continuously and from which partial currents are removed through slotted or perforated diaphragms. The imagewise control of these partial streams is effected by electric signals which are conveyed to the apertures of the diaphragms by means of suitable control electrodes. Alternatively, in the case of imagewise exposure to light which alternates in accordance with the image, this controlling function may be carried out by photoconductive materials. In that case, the apertures in the diaphragms are provided with strips or layers of photoconductive material which are charged by the corona discharge current and give up their charge when exposed to light.

With processes of this kind, electrostatic recordings can be taken over larger electrode distances, e.g. several tenths of a millimetre or up to 1 millimetre. However, these processes are slower in taking recordings than the processes described above in which the electrodes are required to be maintained at distances of only a few $\mu$m. The maximum recording speeds obtainable are of the order of a few cm/sec because the density of charge carrier in the partial stream of corona discharge is much lower than in processes by which the charge is transferred directly from electrode to paper across a very small gap.

It is an object of this invention to increase the recording speed of processes which operate with larger electrode distances.

A process for the electrographic recording of charge images on insulating material, in which a gas discharge is produced by a corona discharge electrode and a part of the discharge current is altered in its intensity by electric signals with the aid of control electrodes and this altered partial current is used for charging the recording material while the recording material is moved past the control electrodes over a counter electrode has now been found which is characterised in that discharage of the gas and control of the discharge current take place in the presence of one or more gases which have an electron affinity of less than 1 eV.

The process according to the invention thus principally consists in that both the corona discharge and the control of the partial stream of this discharge which enables the charge image to be formed are carried out in a gas atmosphere which consists of gases which have a low electron affinity.

Electron affinity is measured by the energy which is released when an additional electron is taken up into the electron shell of an atom. This is normally expressed numerically in terms of electron volts (eV).

Examples of gases with low electron affinity which are suitable for the process of the invention are: Nitrogen, the noble gases helium, neon, krypton, argon and xenon, or hydrogen. From these gases, nitrogen is preferred for economic reasons while noble gases have the advantage of enabling exceptionally high recording speeds to be achieved due to the surprisingly high intensity of the discharge currents produced.

Gases which are suitable are characterised by having an electron affinity of less than 1 eV. The electron affinities given in "Taschenbuch fuer Chemiker und Physiker" by D'Ans-Lax, 2nd Edition 1949, Springer-Verlag, under the heading "Elektronenaffinitaet" are 0.04 eV for nitrogen, −0.53 eV for helium and −1.2 eV for neon. By comparison, the electron affinities for gases which are unsuitable for the process of the invention are significantly higher than 1, for example the electron affinities of electronegative gases are 3.6 eV in the case of chlorine, 3.56 eV in the case of fluorine and 2.34 eV in the case of oxygen (D'Ans-Lax Volume 3, 3rd Edition, 1970).

Nitrogen, which is preferably used for the process of the invention, should not contain more than 10% of impurities; it is affected particularly critically by the presence of electronegative gases as well as moist air or water vapour as impurities. The same applies to the purity of the other gases which have been mentioned as suitable.

Since there is a very low probability of the deposition of the electrons produced by the gas discharge on the gas molecules or atoms of gases which have an electron affinity of less than 1 eV, the majority of the electrons produced remain freely mobile and therefore constitute a charging current which is much more easily controllable than the current of gas ions in air which is formed with the majority of comparatively inert oxygen or water vapour ions. Since the greater speed of migration of the free electrons entails a substantial reduction in the formation of screening space charges in the surroundings of the corona discharge electrode, there is a considerable increase in the discharge current and the density of charge carrier. Hence the charging time required for producing the electrostatic charge image is considerably reduced and the speed of recording increased.

The corona discharge electrodes conventionally used in electrography, which are in the form of thin, stretched wires, cannot be used for discharge in a gas atmosphere according to the invention because in such an atmosphere a sufficiently uniform, continuous surface glow is not formed on the wires but only a few, erratically migrating discharge points which do not yield a uniform charging current are formed. A corona discharge suitable for the process of the invention can be obtained on a free standing, single needle electrode situated at a relatively great distance from the counter electrode. Owing to the high intensity of the discharge current in the said gases, a single needle electrode is sufficient to charge large areas of the recording material within a short time.

The principle of the process of the invention will now be explained more fully with reference to the examples illustrated in the accompanying drawing.

FIGS. 1*a* and 1*b* represent the discharge characteristics of needle discharges in nitrogen and in air respectively.

Figure 5:
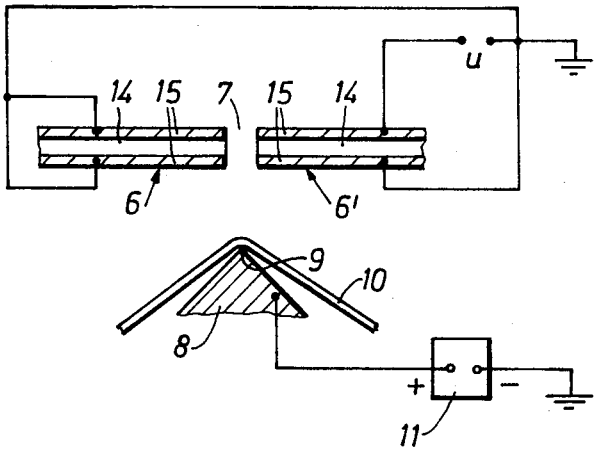

FIG. 5 explains further details of the electrode arrangement and circuit.

Figure 6:
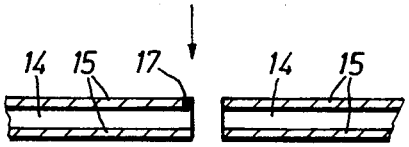

FIG. 6 shows another embodiment of the slit diaphragm in which the control electrodes are replaced by a photoconductive material at the lip of the slit.

Figure 1A:
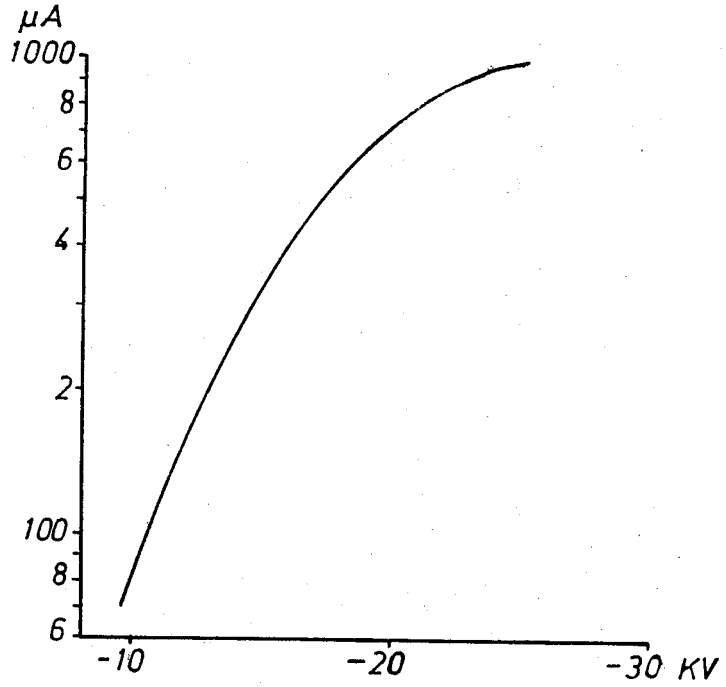
Figure 1B:
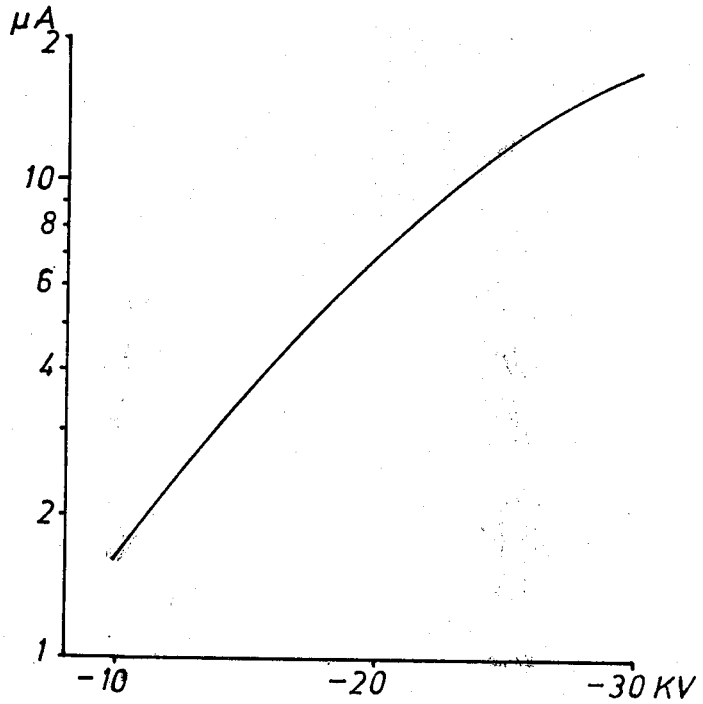

When comparing the current/voltage diagrams for needle discharge in nitrogen (FIG. 1*a*) and in air (FIG. 1*b*), it is immediately obvious that discharge current intensities 100 times greater than those obtained in air at 23°C and 50% relative humidity can be obtained in nitrogen, and hence the necessary condition for a corresponding increase in the speed of recording is given. A considerable increase in the discharge current intensity is obtained when nitrogen is replaced by a noble gas. Both diagrams are obtained with the same electrode arrangement in which the distance between the tip of the electrode and the counter-electrode is 10 cm. The only difference lies in the gas with which the gap is filled.

Figure 2:
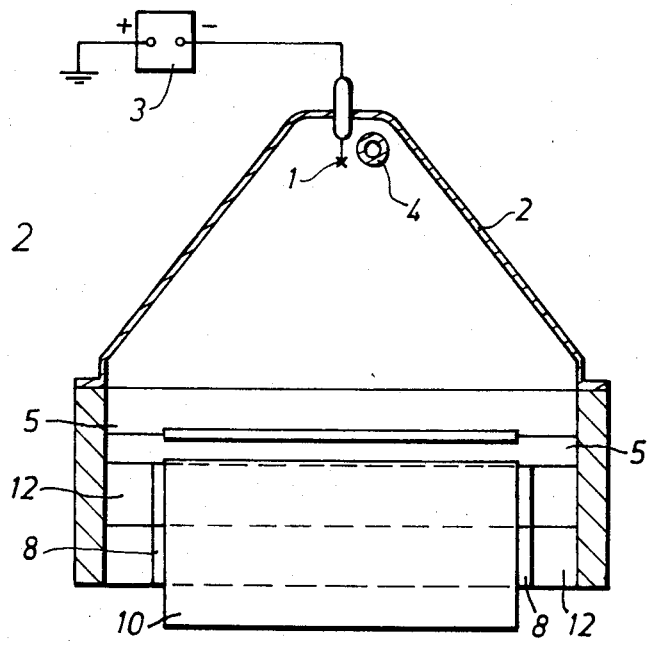
FIGS. 2 and 3 represent sections through an electrographic recording apparatus according to the invention.
Figure 3:
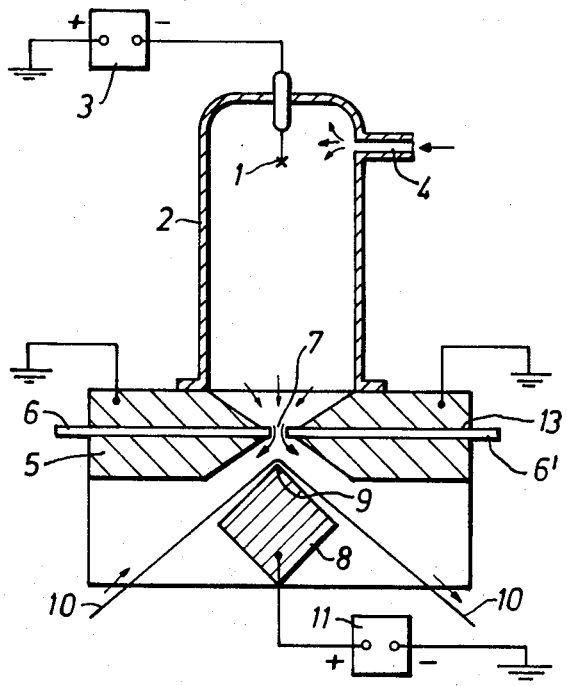

According to FIGS. 2 and 3, the needle discharge is produced in a gas atmosphere according to the invention using a metal needle 1 which is inserted in a housing 2 of transparent insulating material and connected to a voltage source 3. A slow stream of gas is introduced into the housing 2 through a pipe 4 and fills the discharge space. The flow of gas is adjusted to such a rate that inflow of air through the gap 7 into the space enclosed by the housing 2 is prevented. The correct rate of gas delivery can easily be controlled by the charging rate of the needle electrode 1. The charging rate increases while the discharge space is being filled with gas and reaches a maximum as soon as the discharge space has been filled with the optimum amount of gas and the apparatus is ready for use. Thereafter, the flow of gas need only be readjusted to keep the discharge current constant. As a general rule, the larger the open surface of the gap, the stronger is the stream of gas required to maintain the discharge current in a stable state. It is obvious that the distance between the tip of the electrode 1 and the centre of the gap 7 depends on the voltage at which the needle discharge is operated. In other words, greater electrode distances require higher voltages but they also permit the use of gaps of greater length and hence provide the possibility of increasing the recording width. The lower part of the housing 2 forms a clamping device 5 for the flat control electrode inserts 6 and 6' which are clamped into position in such a way as to leave a gap 7 through which the gas entering through the pipe 4 can escape. The gap may have a width of e.g. 0.1 to 0.5 mm, preferably 0.2 mm. Below the gap 7 is the counter electrode 8 with one edge 9 arranged parallel to the gap. The distance of this edge from the centre of the gap may be e.g. 0.1 to 2.0 mm, preferably 0.5 mm. The recording material 10 is placed over this edge and displaced in the direction of the arrow during the recording process. An increase in the distance between the edge 9 and the centre of the gap naturally reduces the power of resolution. At the preferred distance of 0.5 mm, the recording is no longer spoilt by irregularities in the surface of the recording material and at the same time the distance is not sufficient to spoil the sharpness of the image produced. The more sharply the recording material is bent over the edge 9 and the closer the contact is between the electrode and the recording material, the more accurately can the transfer of current from the counter electrode 8 to the recording material be localised. A suitable recording material has been described e.g. in the journal "Electrophotography" (Soc. of Electrophotography of Japan) Vol. 7, No. 3 (1967) pgs. 59 to 68. The counter electrode 8 is connected to another voltage source 11 from which it receives a potential which is opposite in sign to the potential of the needle electrode 8 electrically separated by the insulating elements 12. The control electrode inserts 6 and 6' are at least partly insulated from the conductive parts of the clamping device by an insulating film 13.

Part of the discharge current flows through the gap 7 between the control electrode inserts 6 and 6' and charges the section of the recording material which is situated below the gap. The density of this charge is determined by the voltage ratios between the control electrodes 6, 6' and the counter electrode 8 and by the intensity of the discharge current.

Figure 4:
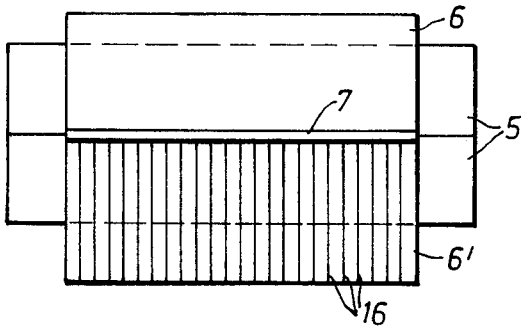
FIG. 4 represents a slit diaphragm with control electrodes.

FIGS. 4 and 5 serve to explain the control process for the discharge current.

FIG. 4 shows part of the clamping device 5, the control electrode inserts 6 and 6' and the gap 7. According to FIG. 5, the control electrode inserts consist e.g. of three-layered plates composed of a middle insulating layer 14 and conductive layers 15 on both sides thereof. The whole thickness of the plates may be in the region of 0.05 mm to 1 mm and is preferably about 0.2 mm. Suitable control electrode inserts are made, for example, of polyester foils laminated on both sides with a layer of copper or covered with layers of metal applied by a vapour coating process. The layers applied by lamination may have a thickness of about 35 $\mu$ whilst the layers applied by vapour coating may have a thickness of about 1 to 2 $\mu$. One of the conductive coatings is subdivided into strips extending perpendicularly to the gap. These can easily be produced e.g. by the known techniques of photo etching. The control signal can be carried to the lip of the control electrode along these conductive strips 16 which are insulated from each other while the other covering layers of the electrode are electrically connected to each other and connected to the earth terminal of the apparatus. When a control voltage U is applied to the strips 16, electric fields which attenuate or suppress the passage of charging current are produced in the gap 7. In this way, a control charging of the recording material is achieved whereby charging patterns in the form of either areas, lines or dots can be obtained.

FIG. 6 illustrates the control of the discharge current by means of a photo conductor. By applying a thin strip 17 of photoconductive material, e.g. zinc oxide, cadmium sulfide selenium or polyvinylcarbazole to one lip of the gap and charging the strip 17 with the discharge current, for example, the passage of current through the gap can be prevented so long as the process takes place in the dark. If the photoconductive material is completely or partly exposed to light from time to time, it loses its charge so that current can pass through the gap in the exposed areas.

The charge images produced by the process according to the invention may be rendered visible by the usual methods of electrophotography which have been described e.g. in Chapter IX of "Xerography and Related Processes", the Focal Press London and New York.

The apparatus illustrated in FIGS. 2 to 6 serve as examples to explain the process of the invention. The recording speeds can be increased at least tenfold by using the gases mentioned above which have a low electron affinity. It is surprisingly found that in spite of the higher charge current density and speed of recording, only relatively low control voltages of e.g. 0 to 100 V are required for completely controlling the apparatus illustrated in FIGS. 1 to 6 and obtaining the contrasts of charge and of blackness generally obtainable on electrographic recording materials. The process according to the invention can therefore be applied wherever rapid and accurate recording of charge images is required.

What we claim is:

1. The electrographic recording process of producing charge images on a recording material capable of being electrically charged by establishing a gas discharge current stream applying a voltage between a corona discharge electrode and a counter electrode, and controlling the density of the charge of the recording material by selectively applying a control potential to control electrodes interposed between said corona discharge electrode and said counter electrode, whereby part of the discharge current stream is changed in its intensity by means of said control electrodes, moving the recording material past the control electrodes and over the counter electrode, wherein the improvement comprises carrying on the gas discharge and control of the discharge partial current while positioning the corona discharge electrode, counter electrode and control electrode in a gas stream consisting of a gas having an electron affinity of less than 1 eV whereby this gas is ionized to selectively charge the record.

2. A process as claimed in claim 1, in which the gas discharge current stream is produced on a needle electrode which is arranged free standing in a housing of insulating material which separates the volume between the needle electrode and the control electrodes from the external atmosphere and through which the gas stream of gas with an electron affinity of less than 1 eV is passed.

3. A process as claimed in claim 2 in which the distance between the needle electrode and the control electrode is 10 cm.

4. A process as claimed in claim 2 in which the discharge partial current is controlled by a strip of photoconductive material which is arranged along the lip of the gap of one of the two control electrodes, on the side facing the needle electrode.

5. A process as claimed in claim 2 in which the gas is admitted into the housing through an opening near the needle electrode and escapes through a gap between the control electrodes provided for the passage of the discharge partial current.

6. A process as claimed in claim 5 in which the gap between the control electrodes has a width of between 0.1 and 0.5 mm.

7. A process as claimed in claim 6 in which the gap has a width of 0.2 mm.

8. A process as claimed in claim 5, in which the recording material is passed over the counter electrode during the charging process in such a way that it forms a fold parallel to the centre of the gap between the counter electrode.

9. A process as claimed in claim 8 in which the fold in the recording material is situated at a distance of between 0.5 and 2.0 mm from the gap between the control electrodes.

10. A process as claimed in claim 9 in which the distance between the fold and the gap is 0.5 mm.

11. A process as claimed in claim 1 in which the electrodes used for controlling the discharge partial current consist of foils of insulating material covered with conductive coatings on both sides and defining gap therebetween, the conductive coating of one of the two control electrodes which form the gap being subdivided on the side facing the needle electrode into strips extending substantially perpendicularly to the gap which are insulated from each other and which end at the lip of the gap between the control electrodes and along which the electric signals are coveyed to the gap.

12. A process as claimed in claim 11 in which the discharge partial current is controlled by means of a control voltage applied to the conductive strips on the side of the control electrode facing the needle electrode.

13. A process as claimed in claim 11 in which the control electrode has a total thickness of between 0.05 mm and 1 mm.

14. A process as claimed in claim 13 in which the total thickness of the control electrode is 0.2 mm.

* * * * *

UNITED STATES PATENT AND TRADEMARK OFFICE

CERTIFICATE OF CORRECTION

PATENT NO. : 3,978,492

DATED : Aug. 31, 1976

INVENTOR(S) : Walter Simm

It is certified that error appears in the above-identified patent and that said Letters Patent are hereby corrected as shown below:

Front page, last word of the title after [54], "Case" should be -- Gas -- .
Column 1, last word of the title, "Case" should be -- Gas -- .
Column 1, lines 41-42, "laragely" should be -- largely -- .

Signed and Sealed this

Fourteenth Day of December 1976

[SEAL]

*Attest:*

RUTH C. MASON
*Attesting Officer*

C. MARSHALL DANN
*Commissioner of Patents and Trademarks*